US008025190B2

(12) United States Patent
Barbanti

(10) Patent No.: US 8,025,190 B2
(45) Date of Patent: Sep. 27, 2011

(54) UPGRADED IRONING MACHINE FOR IRONING TROUSERS

(75) Inventor: Carlo Barbanti, Mirandola (IT)

(73) Assignee: Barbanti Carlo S.n.c., Mirandola (MO) (IT)

( * ) Notice: Subject to any disclaimer, the term of this patent is extended or adjusted under 35 U.S.C. 154(b) by 411 days.

(21) Appl. No.: 12/309,187

(22) PCT Filed: Jul. 10, 2007

(86) PCT No.: PCT/IB2007/001915

§ 371 (c)(1),
(2), (4) Date: Feb. 9, 2009

(87) PCT Pub. No.: WO2008/007200

PCT Pub. Date: Jan. 17, 2008

(65) Prior Publication Data

US 2010/0115805 A1 May 13, 2010

(30) Foreign Application Priority Data

Jul. 11, 2006 (IT) ..... MO2006A0224

(51) Int. Cl.
*D06F 71/29* (2006.01)
*D06F 71/16* (2006.01)
*D06F 71/36* (2006.01)

(52) U.S. Cl. ..... 223/73; 38/7; 38/12; 38/16

(58) Field of Classification Search ..... 38/7–16, 38/21–24, 66; 223/52, 57, 63, 66–74
See application file for complete search history.

(56) References Cited

U.S. PATENT DOCUMENTS

| | | | | |
|---|---|---|---|---|
| 2,147,596 | A * | 2/1939 | Long | 223/57 |
| 2,627,128 | A * | 2/1953 | Jones | 38/21 |
| 3,578,790 | A * | 5/1971 | Radford et al. | 223/73 |
| 3,835,559 | A * | 9/1974 | Kotter | 38/21 |
| 3,837,543 | A * | 9/1974 | Brollos | 223/73 |
| 4,473,961 | A * | 10/1984 | Frushtick | 38/42 |
| 4,479,314 | A * | 10/1984 | Frushtick | 38/42 |
| 4,485,572 | A | 12/1984 | Frushtick | |
| 5,711,097 | A | 1/1998 | Minó | |
| 7,032,336 | B2 | 4/2006 | Bedretdinov | |

FOREIGN PATENT DOCUMENTS

DE 2017394 10/1971

* cited by examiner

*Primary Examiner* — Ismael Izaguirre
(74) *Attorney, Agent, or Firm* — Dykema Gossett PLLC

(57) ABSTRACT

Upgraded ironing machine, particularly for ironing trousers, comprising a supporting structure (2) of at least two substantially vertical pressing plates (3), arranged so they are facing each other and moving from a home configuration, wherein the pressing plates are substantially a long way from each other, and a working configuration wherein the pressing plates are substantially close together, at least one ironing plate (4) substantially vertical and interposable between the pressing plates in the working configuration, at least one supporting element of at least one pair of trousers positionable with the legs laid respectively on the opposite sides of the ironing plate and automated positioning means of the trousers with respect to the ironing plate.

39 Claims, 2 Drawing Sheets

UPGRADED IRONING MACHINE FOR IRONING TROUSERS

TECHNICAL FIELD

The present invention refers to an upgraded ironing machine, particularly for ironing trousers.

BACKGROUND ART

It is common knowledge that professional ironing machines for ironing clothes are used in the industrial laundry sector or for industrial ironing in general.

With particular reference to ironing the crease of trousers, machines are known comprising a supporting structure of a horizontal resting surface for trousers and a press associated with the supporting structure that moves close to and away from the resting surface.

The press generally has a plurality of steam blow holes and is connected to a steaming system.

Before ironing, an operator lays the trousers on the resting surface, paying particular attention to laying them correctly in order to make the crease along the length of the trousers, at the front and back of the legs.

To iron the trousers, the press is then lowered and put on top of the resting surface with the simultaneous emission of steam from the blow holes.

These known machines are not, however, without drawbacks, among which is the difficulty of the manual operation in positioning the trousers on the resting surface, before they are ironed, wasting a considerable amount of time and labour.

Another problem with this embodiment is the fact it is impossible to iron well in the area between the crutch and the waistband, meaning manual interventions are then necessary which waste still more time and labour.

A second type of known machine entails a supporting frame with a compartment for housing a pair of vertical steam pressing plates, facing each other and moving to and away from each other.

A rigid ironing board and covered with an appropriate transpiring material (e.g. fabric), is associated with the supporting frame, parallel to the plates and movable thanks to the action of actuator means from a position outside the compartment to a position inside the compartment, with interposition between the pressing plates.

Such machines also comprise supporting means to support a pair of trousers, of the spring clip, hanger type or the like; the trousers are positionable with the legs extended along the opposite sides of the ironing plate, respectively.

Before ironing, an operator positions the trousers by hand on the ironing board. The ironing board is then moved inside the compartment, between the pressing plates which come close to each other and steam iron the trousers.

Once the ironing board has been moved back into the position outside the compartment the trousers can be removed for the next finishing phases.

Although these machines do partly simplify the manual operation of positioning the trousers on the ironing board, they still have some drawbacks.

The supporting means, in fact, have to be suitably adapted, before ironing can be done, to allow the correct positioning of trousers of different sizes, lengths, widths and styles with a waste of time and use of labour that all contribute in increasing the overall cost of the ironing process.

In addition, while ironing, creases are normally formed in the crutch of the trousers which have to be put right in subsequent manual finishing operations, costly in terms of time and labour.

OBJECT OF THE INVENTION

The main aim of the present invention is to provide an upgraded ironing machine, particularly for ironing trousers, that ensures to simplify the operations of positioning the trousers before the ironing process.

Within the scope of this technical aim, another purpose of the invention is to obtain correct ironing also in the areas between the crutch and the waistband of the trousers.

Another object of the present invention is to cater for the above aims with a simple structure, of relatively practical implementation, safe to use and with effective operation, as well as having a relatively low cost.

The objects described above are all achieved by the present upgraded ironing machine, particularly for ironing trousers, comprising a supporting structure of at least two substantially vertical pressing plates arranged so they are facing each other and moving from a home configuration, wherein said pressing plates are substantially a long way from each other, and a working configuration wherein said pressing plates are substantially close together, at least one ironing plate substantially vertical and interposable between said pressing plates in said working configuration and at least one supporting element of at least one pair of trousers positionable with the legs laid respectively on the opposite sides of said ironing plate, characterised in that it comprises automated positioning means of said trousers with respect to said ironing plate.

BRIEF DESCRIPTION OF THE DRAWINGS

Further characteristics and advantages of the present invention will appear even more evident from the detailed description of a preferred, but not exclusive, embodiment of an upgraded ironing machine, particularly for ironing trousers, illustrated indicatively by way of non limiting example, in the attached drawings wherein:

the FIGS. 1 and 2 are perspective views of the ironing machine according to the invention.

EMBODIMENTS OF THE INVENTION

Figure 1:
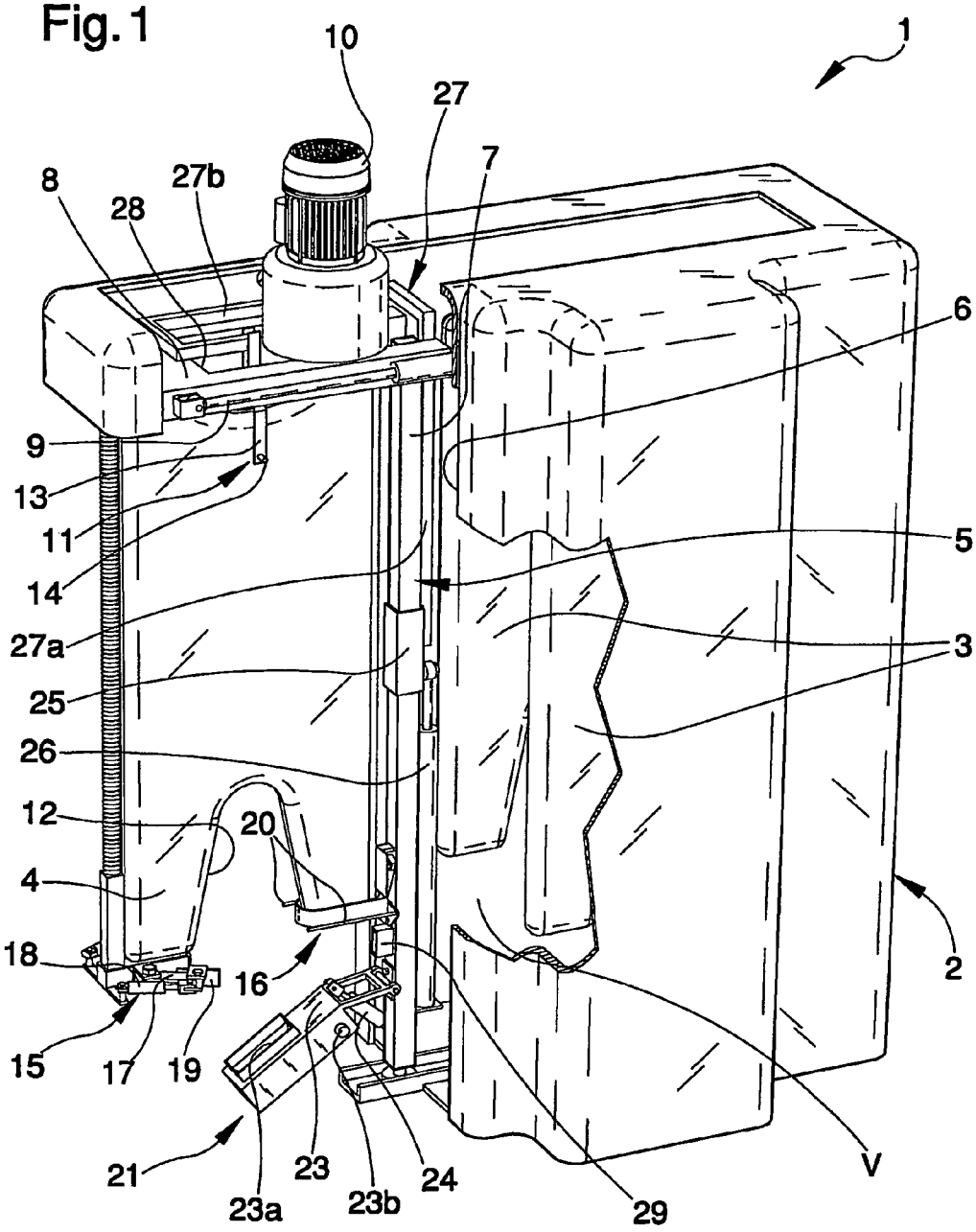
Figure 2:
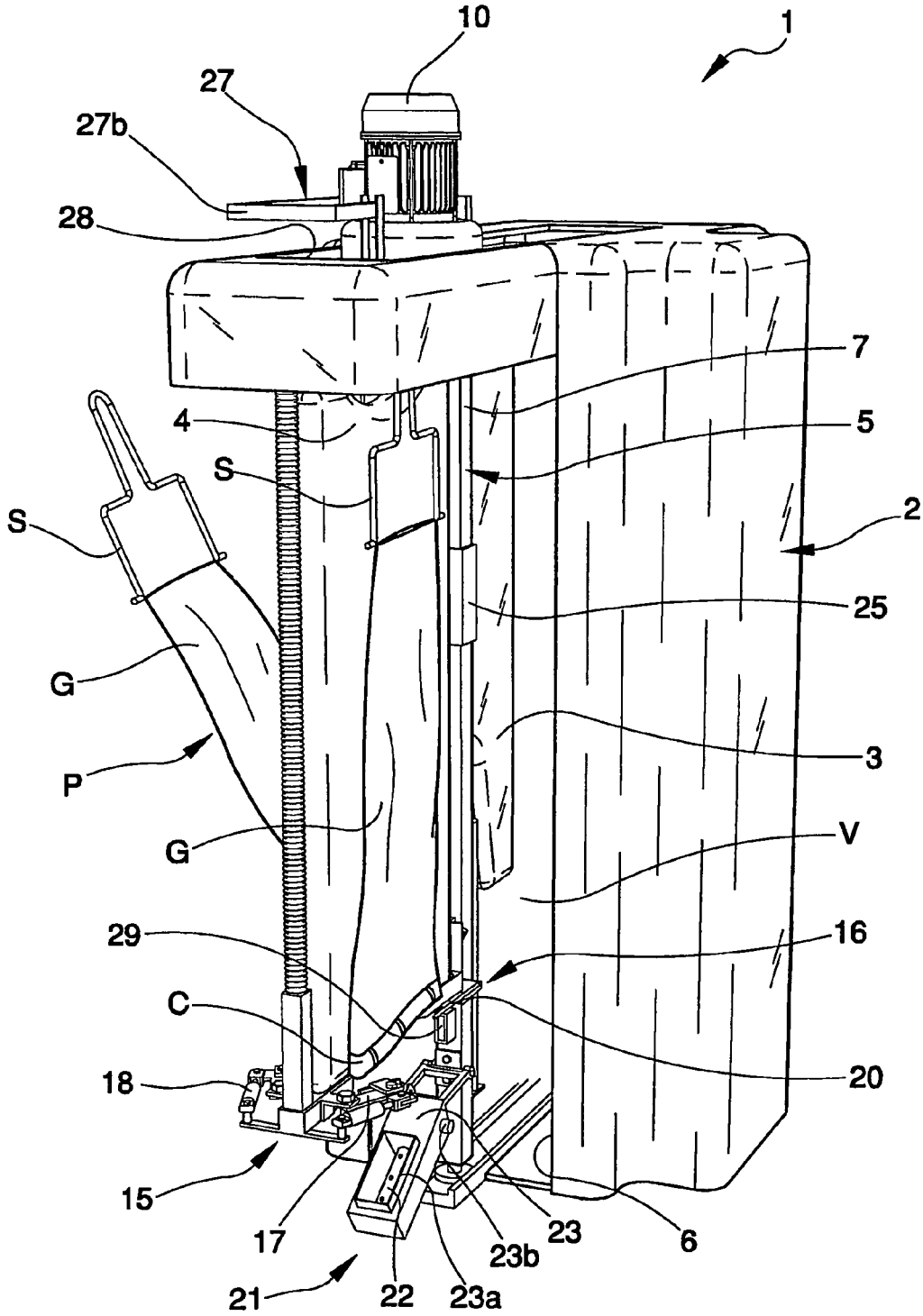

With special reference to such figures, an upgraded ironing machine which can be used for ironing trousers has been globally designated by reference number 1.

The machine 1 comprises a supporting structure 2 of at least two substantially vertical pressing plates 3.

In particular, the pressing plates 3 are arranged inside a compartment V of the supporting structure 2 and face each other and are movable through the action of electromechanical, pneumatic and/or hydraulic means between a home configuration, wherein they are substantially far away from each other, and a working configuration, wherein they are substantially close together.

Usefully, the pressing plates 3 comprise internal metal sheets which are operatively associated with a steaming and/or suction system.

The internal sheets have the respective sides opposite each other with a plurality of holes for supplying/suctioning steam or air and have a covering in a transpiring material or, alternatively, have a plurality of transpiring holes.

The machine 1 comprises an honing plate 4 which is substantially vertical and which is interposable between the two pressing plates 3, parallel to them, in the above mentioned working configuration.

Particularly, the ironing plate 4 is supported by a framework 5 that is associated sliding horizontally to the supporting structure 2 along linear guides between an external position, in which the ironing plate 4 is arranged externally to the compartment V, and an internal position, in which the ironing plate 4 is arranged internally to the compartment V, and is interposed between the pressing plates 3.

The ironing plate 4 is movable between the first position and the second position through a vertical slit 6 defined on the supporting structure 2.

The framework 5 comprises an upright 7 to which is fixed, in one or more points, one of the vertical sides of the ironing plate 4, and a frame 8 which extends substantially horizontally from the upper end of the upright 7 and to which the top side of the ironing plate 4 is fixed in one or more points.

A pneumatic cylinder 9 is fixed, at one end, to the supporting structure 2 and, at the opposite end, to the frame 8 and is suitable for moving the framework 5 (and the ironing plate 4) between the external position and the internal position.

Usefully, the ironing plate 4 comprises an internal metal sheet having air suction means and covered with a layer made in a transpiring material, of the cloth type or the like or, anyway, with a plurality of transpiring holes.

The air suction means are made up of a plurality of suction holes distributed on both sides of the internal sheet and connected to a suction motor 10 fixed to the top of the frame 8.

However, a different arrangement of the suction motor 10 on the machine 1 or the use of different suction sources cannot be ruled out.

The machine 1 comprises a supporting element 11 for a pair of trousers P positionable with the legs G extended on the opposite sides of the ironing plate 4 respectively.

Advantageously, the lower portion of the ironing plate 4 is shaped to define a housing cavity 12 for housing the crutch of the trousers P with the opening marked by the waistband C of the trousers P facing downwards and the legs G that extend vertically and upwards on the sides of the ironing plate 4.

Similarly, the lower portion of the pressing plates 3 is shaped to reproduce the profile of the housing cavity 12.

The supporting element 11 is arranged in proximity of the upper edge of the ironing plate 4, it is shaped like a fork and comprises two projecting parts 13 that extend substantially vertically and downwards by the opposite sides of the ironing plate 4.

The projecting parts 13 have respective fastening pins 14 to which a pair of hangers S are temporarily fixable associated with the free ends the legs G. Alternatively, the supporting element 11 can comprise a pair of supporting clamps, of the pneumatic or electromechanical type, arranged on the opposite sides of the ironing plate 4 and suitable for closing tightly onto the hangers S or by the free ends of the legs G of the trousers P.

The machine 1 comprises automated gripping means suitable for holding the trousers P on the ironing plate 4.

In particular, the gripping means comprise a first holding clamp 15 and a second holding clamp 16, of the pneumatic clamp type, which are defined at the lower portion of the ironing plate 4, in proximity of the opposite vertical sides respectively and which are suitable for closing tightly onto substantially opposite parts of the trousers P in proximity of the waistband C.

The first holding clamp 15 comprises a pair of small arms 17 hinged on a metal support by the lower edge and on opposite sides of the ironing plate 4, on the side opposite that anchored to the upright 7.

The small arms 17 are turnable simultaneously thanks to the action of respective pneumatic cylinders 18 and have the free end with plaques 19 suitable for closing tightly onto a rear portion of the trousers P.

The second holding clamp 16 comprises a pair of rods 20 substantially parallel to the board defined by the ironing plate 4, arranged on opposite sides of the ironing plate 4 in proximity of the upright 7.

The rods 20 are movable near to and away from the ironing plate 4 thanks to the action of hydraulic, pneumatic or electromechanical means and are suitable for closing tightly onto a front part of the trousers P.

However, different arrangements and/or different shapes of the first and second clamp 15 and 16 cannot be ruled out.

Usefully, the ironing plate 4 has a portion suitable for receiving the front part of trousers with a cross section substantially bigger than the portion of the ironing plate suitable for receiving the rear part of the trousers P.

In particular, the cross section of the ironing plate 4 is substantially growing from the external vertical edge towards the upright 7 to guarantee correct stretching of the trousers P and an arrangement of the legs G suitable for the correct realisation of the longitudinal creases along the length of the legs. Advantageously, the machine 1 comprises emission means 21 of a flow of air and/or steam inside the trousers P through the opening marked by the waistband C when the ironing plate 4 is positioned inside the compartment V and the two pressing plates 3 are in the working configuration.

In particular, the emission means 21 comprise a blowing element 22 of compressed air and/or steam connectable, at one's discretion, to a compressed air generator or to a steam generator.

The blowing element 22 is substantially cylindrical and elongated in shape and has a plurality of air/steam outlet vents, aligned with one another, and an air/steam inlet vent.

Automatic selection devices, of the solenoid valve type or the like, allow the connection of the inlet vent to the compressed air circuit or to the steam circuit. The blowing element 22 is housed inside a small frame 23 with an end hinged to the upright 7 at the bottom of the ironing plate 4 and turnable, moving towards and away from the cavity 12 of the ironing plate 4 itself.

The small frame 23 has an emission opening 23*a* for the air or steam defined by the outlet vents of the blowing element 23 and a mouth 23*b* defined by the inlet vent of the blowing element 22 and connectable to the compressed air circuit and/or the steam circuit.

The emission means 21 also comprise rotation actuator means 24 for rotating the small frame 23 between a lowered configuration and a substantially horizontal configuration, wherein the flow of air emitted from the outlet vents of the blowing element 22 moves along a substantially vertical direction through the opening of the trousers P and towards the crutch.

Usefully, the rotation actuator means 24 are made up of a linear actuator, of a pneumatic, hydraulic or electromechanical cylinder type or the like, interposed between the upright 7 and a substantially median section of the small frame 23. Alternatively, the emission means 21 can comprise one or more fans associated with a heating element of the air flow, for example, of the conventional electrical resistor type.

In addition, the machine 1 has automated positioning means of the trousers P on the ironing plate 4 which comprise moving means for moving the supporting element 11 along a substantially vertical moving direction.

Particularly, the moving means comprise a sliding element 25, of the trolley type, movable along the upright 7 thanks to the action of sliding actuator means 26.

The sliding actuator means 26 are composed of a linear actuator, of the pneumatic cylinder type, fixed, at one end, by a bottom section of the upright 7 and, at the opposite end, to the trolley 25.

An arm 27 is integrally associated with the trolley 25 and has a first section 27*a* that extends in a substantially vertical direction from the trolley 25 upwards and a second section 27*b* that extends in a substantially horizontal direction from the first section 27*a* and which has the supporting element 11.

Particularly, the second section 27*b* is defined at the top with respect to the frame 8 and is shaped so as to reproduce at least partially the profile of the suction motor 10; the supporting element 11 extends vertically from an end of the second section 27*b* through an opening 28 on the frame 8.

Advantageously, the automated positioning means comprise at least one detection device 29 for detecting the position of the trousers P with respect to the ironing plate 4 which is operatively connected to the moving means.

The detection device 29 is made up of a position sensor, of the infrared, ultrasound type or the like, and is associated with the upright 7 at the bottom of the ironing plate 4 and at the top with respect to the small frame 23.

The machine 1 comprises a management and control unit, of a microprocessor system, PLC type or the like, which is operatively connected to the first and second clamp 15 and 16, to the sliding actuator means 26 and to the rotation actuator means 24, to the suction motor 10, to the pneumatic cylinder 9 and to the automated positioning means of the supporting element 11.

The invention works as described below.

First of all an operator hangs the hangers G, up to which the free ends of the legs G of a pair of trousers P are fixed, by the supporting element 11.

During this procedure the operator arranges the crutch of the trousers P by the housing cavity 12 and stretches the legs G out on the respective sides of the ironing plate 4, arranging them in an appropriate manner so the creases can be ironed in lengthwise, both at the front and at the back.

Subsequently, the automated positioning means, started by the operator, arrange the trousers P at a preset height on the ironing plate 4 for correct ironing depending on factors such as dimensions, size, model, etc.

In particular, the moving means move the supporting element 11 either upwards or downwards until the position sensor 29 detects the end part of the trousers P, in proximity of the waistband C.

Once the trousers are positioned, the operator fixes the trousers P to the first and second clamp 15 and 16 by a rear portion and a front portion of the waistband C respectively.

The subsequent start of the suction means (and of the suction motor 10 in particular) allows the adhesion between the ironing plate 4 and the trousers P to facilitate stretching of all parts of the trousers P and to allow the operator a more accurate control and a correct arrangement prior to ironing.

The operator can, at this point, start the automatic ironing procedure.

Once the ironing plate 4 is inside the compartment V thanks to the action of the pneumatic cylinder 9, the pressing plates 3 approach each other until they close on the ironing plate 4 in the working configuration.

A plurality of steam blasts are emitted from the supplying holes towards the trousers P and at least part of the steam, thus generated, is suctioned by the suction holes on the sides of the ironing plate 4, thus allowing to maintain an optimum humidity level.

Preliminarily to the ironing phase and during the movement of the ironing plate 4 from the external position to the internal position, the small frame 23 turns and places itself in the substantially horizontal configuration and the blowing element 22 generates a flow of air or steam that causes the trousers P to balloon out in the area between the crutch and the waistband C. This ballooning stretches the fabric in this area, preliminarily and during ironing, and prevents unwanted creases forming.

After a predetermined interval of time, the pressing plates 3 move away from each other back into the home configuration and the ironing plate 4 moves back into the external position.

At this point, all the ironing phases have been executed and the operator can remove the trousers from the first and second clamp 15 and 16 and from the supporting element 11.

It has been seen how the invention described achieves the intended objects and, in particular, the fact is underlined that the presence of the automated positioning means make it possible to simplify greatly the phases of preparing the trousers for ironing.

In particular, preliminary operations are no longer required by the operator on the machine suitable for adapting the supporting element to different types of trousers in terms of dimension, size, model, etc.

Another advantage is given by the presence of the emission means of the flow of air which allows correct ironing without any unwanted creases even in the areas between the crutch and the waistband of the trousers.

This, plus the particular shape of the cavity and of the pressing plates, allows to obtain longitudinal creases along the trouser legs, both at the back and the front, even higher than is normally obtained with the machines of the known type.

In addition, the position of the trousers on the ironing plate, with the waistband facing downwards and the legs stretched vertically upwards, makes it possible to stretch the fabric of the pockets downwards when ironing, limiting still further the possibility of unwanted creases forming.

The invention thus conceived is susceptible of numerous modifications and variations, all of which falling within the scope of the inventive concept. Furthermore all the details may be replaced by other elements which are technically equivalent.

In practice, the contingent shapes and dimensions may be any according to requirements without because of this moving outside the protection scope of the following claims

The invention claimed is:

1. An upgraded ironing machine for ironing trousers, comprising:

a supporting structure of at least two substantially vertical pressing plates arranged so they are facing each other and moving from a home configuration, wherein said pressing plates are substantially a long way from each other, and a working configuration wherein said pressing plates are substantially close together, at least one ironing plate substantially vertical and interposable between said pressing plates in said working configuration, at least one supporting element of at least one pair of trousers, and automated positioning means of said trousers with respect to said ironing plate, wherein said trousers are positionable vertically in said ironing machine with the free ends of the legs arranged upwards for being supported by said supporting element, with the legs laid and extended upwards respectively on the opposite sides of said ironing plate, and with the waistband and crutch of the trousers arranged downwards in the zone of and by a lower portion of said ironing plate, and in that said automated positioning means comprise moving means associated with said ironing plate for moving said supporting element and said ironing plate relatively each other along at least one moving direction substantially vertical, and at least one detection device, operatively connected to said moving means, for detecting the position of the waistband of said trousers with respect to said ironing plate.

2. The machine according to claim 1, wherein said moving means comprise at least one sliding element moving on a framework of said ironing plate along said moving direction.

3. The machine according to claim 2, wherein said moving means comprise sliding actuator means of said sliding element.

4. The machine according to claim 3, wherein said sliding actuator means comprise at least one linear actuator associated, at one end, with said framework and associated, at the opposite end, with said sliding element.

5. The machine according to claim 3, wherein said sliding actuator means are of a pneumatic, hydraulic or electromechanical cylinder type.

6. The machine according to claim 2, wherein said moving means comprise at least an arm integrally associated with said sliding element and with which said supporting element is associated.

7. The machine according to claim 6, wherein said arm comprises a substantially vertical first section associated with said sliding element and a second section that extends substantially horizontally from said first section and which has said supporting element.

8. The machine according to claim 1, wherein said detection device comprises at least one position sensor.

9. The machine according to claim 8, wherein said sensor is associated with at least one between a framework of said ironing plate and said supporting structure, below with respect to said ironing plate.

10. The machine according to claim 1, wherein it comprises emission means of at least one flow of air and/or steam inside said trousers and through the opening marked by the waistband of said trousers.

11. The machine according to claim 10, wherein said emission means comprise at least one blowing element of air and/or steam arranged in proximity of the lower portion of said ironing plate.

12. The machine according to claim 11, wherein said blowing element comprises at least one air and/or steam outlet vent turned towards said ironing plate and at least one air and/or steam inlet vent associable with at least one air and/or steam generator.

13. The machine according to claim 11, wherein said blowing element is substantially cylindrical hollow and elongated in shape.

14. The machine according to claim 10, wherein said emission means comprise a small supporting frame of said blowing element having an end hinged to a supporting framework of said ironing plate.

15. The machine according to claim 14, wherein said emission means comprise rotation actuator means for rotating said small frame close to and away from said ironing plate.

16. The machine according to claim 15, wherein said rotation actuator means comprise at least a linear actuator interposed between said framework and said small frame.

17. The machine according to claim 14, wherein said rotation actuator means are of the pneumatic, hydraulic or electromechanical cylinder type.

18. The machine according to claim 10, wherein said emission means comprise at least one fan.

19. The machine according to claim 12, wherein said fan is associated with at least one heating element of said air flow.

20. The machine according to claim 19, wherein said heating element is of the electrical resistor type.

21. The machine according to claim 1, wherein said lower portion of the ironing plate is shaped to define a housing cavity for housing the crutch of said trousers.

22. The machine according to claim 1, wherein said supporting element is arranged in proximity of an upper portion of said ironing plate.

23. The machine according to claim 1, wherein said supporting element comprises at least two projecting parts defined in proximity of the upper edge of said ironing plate and by the opposite sides of said ironing plate to which the free ends of the legs of said trousers are temporarily fixable.

24. The machine according to claim 1, wherein said supporting element comprises at least one supporting clamp of said trousers.

25. The machine according to claim 24, wherein said supporting element comprises at least two of said supporting clamps arranged on opposite sides of said ironing plate.

26. The machine according to claim 1, comprising automated gripping means of at least a part of said trousers.

27. The machine according to claim 26, wherein said gripping means comprise at least one first holding clamp of said trousers arranged in proximity of said lower portion of said ironing plate.

28. The machine according to claim 27, wherein said gripping means comprise at least one second holding clamp of said trousers arranged in proximity of the lower portion of said ironing plate, said first and said second holding clamp being provided in proximity of substantially opposite vertical edges of said ironing plate.

29. The machine according to claim 28, wherein at least one between said first holding clamp, said second holding clamp of said gripping means and a supporting clamp of said supporting element is of the pneumatic, hydraulic or electromechanical operated type.

30. The machine according to claim 1, wherein said ironing plate comprises air suction means.

31. The machine according to claim 30, wherein said air suction means comprise a plurality of suction holes distributed on at least one of the sides of said ironing plate.

32. The machine according to claim 1, wherein said ironing plate has a cross section substantially growing from the portion suitable for receiving the rear part of said trousers to the portion suitable for receiving the front part of said trousers.

33. The machine according to claim 1, wherein said lower portion of the ironing plate defines a housing cavity for housing the crutch of said trousers, wherein the lower portion of said pressing plates is shaped to reproduce the profile of said housing cavity.

34. The machine according to claim 1, wherein said ironing plate is supported by a supporting framework, wherein said framework is associated slidingly to the supporting structure between an external position, in which said ironing plate is arranged externally to a compartment of the supporting structure and an internal position, in which said ironing plate is arranged internally to said compartment and is interposed between said pressing plates, substantially parallel to these.

35. The machine according to claim 1, comprising a management and control unit operatively connected to said automated positioning means.

36. The machine according to claim 10, comprising a management and control unit operatively connected to said emission means.

37. The machine according to claim 24, comprising a management and control unit operatively connected to said supporting clamp.

38. The machine according to claim 26, comprising a management and control unit operatively connected to said gripping means.

39. The machine according to claim 30, comprising a management and control unit operatively connected to said suction means.

* * * * *